US007120973B2

(12) United States Patent
Ducauchuis

(10) Patent No.: US 7,120,973 B2
(45) Date of Patent: Oct. 17, 2006

(54) METHOD OF PRODUCING SELF-FASTENING SYSTEMS WITH HOOKING MUSHROOMS AND LOOPS, HAVING A VERY LONG LIFE, AND SELF-FASTENING SYSTEMS OBTAINED BY THE METHOD

(75) Inventor: Jean-Pierre Ducauchuis, Nantes (FR)

(73) Assignee: Aplix, (FR)

( * ) Notice: Subject to any disclaimer, the term of this patent is extended or adjusted under 35 U.S.C. 154(b) by 119 days.

(21) Appl. No.: 10/866,372

(22) Filed: Jun. 10, 2004

(65) Prior Publication Data

US 2005/0000066 A1 Jan. 6, 2005

(30) Foreign Application Priority Data

Jul. 4, 2003 (FR) ..... 03 08200

(51) Int. Cl.
*A44B 18/00* (2006.01)

(52) U.S. Cl. ..... 24/452; 24/442

(58) Field of Classification Search ..... None
See application file for complete search history.

(56) References Cited

U.S. PATENT DOCUMENTS 5,212,853 A * 5/1993 Kaneko ..... 24/452
5,671,512 A * 9/1997 Hattori et al. ..... 24/452
5,797,170 A * 8/1998 Akeno ..... 24/452
6,162,040 A 12/2000 Clune ..... 425/363
6,904,649 B1 * 6/2005 VanBenschoten et al. .... 24/452
2003/0074771 A1 * 4/2003 Duffy ..... 24/442

FOREIGN PATENT DOCUMENTS

DE 196 46 318 A1 5/1998
DE 198 28 856 C1 10/1999
EP 0 793 923 A1 9/1997

* cited by examiner

*Primary Examiner*—Robert J. Sandy
(74) *Attorney, Agent, or Firm*—Renner, Kenner, Greive, Bobak, Taylor & Weber

(57) ABSTRACT

The present invention concerns a male element of mushroom shape for a self-fastening closure, particularly of the hook and loop type, comprising a cylindrical rod (2) having a longitudinal axis and a cross-section, a flange (5) projecting laterally from the rod (2) and extending substantially all around the rod, characterised in that the rod has a constant cross-section or one that decreases strictly from the bottom of the rod to its apex, and there is formed in the rod an auxiliary cavity (6) of which the largest section transversely of the rod axis is of a smaller dimension than that of the cross-section of the rod (2).

16 Claims, 4 Drawing Sheets

METHOD OF PRODUCING SELF-FASTENING SYSTEMS WITH HOOKING MUSHROOMS AND LOOPS, HAVING A VERY LONG LIFE, AND SELF-FASTENING SYSTEMS OBTAINED BY THE METHOD

This invention relates to a method of producing male elements, particularly hooking mushrooms, for self-fastening systems having male and female elements. The invention also relates to moulding rollers for the production of male elements of this kind. Finally, this invention relates to male elements of the kind that can be obtained by the method according to the invention and to self-fastening systems comprising male elements according to the invention.

At the present time, mushrooms (i.e. elements having a substantially cylindrical, particularly circular, rod, and a flange projecting laterally from the apex of the rod over approximately 360°, particularly projecting therefrom by a constant distance, for example substantially cylindrical elements of revolution, particularly circular, having in longitudinal section the shape of a hook) are produced by thermoforming by passing thermoplastic material between a moulding roller and a compression roller, the moulding roller comprising a network of moulding cavities, generally of circular cylindrical shapes, into which the softened or liquid thermoplastic material penetrates. At the outlet of the moulding roller, and after cooling, a strip of thermoplastic material is obtained from which studs project, said studs being of complementary shape, generally circular cylindrical, to the moulding cavities. There is then applied to the upper surface of these studs a pressure roller with heating to deform by thermoforming the top part of the studs in order to obtain one or more flanges with an upper lateral projection, which forms the hooking part of the male hooking elements which will hereinafter be referred to as mushrooms for convenience.

In current mushrooms, the entire upper surface of the rod is compressed, the flanges projecting heightwise at the sides. These mushrooms have particularly the following disadvantage. Once they have been introduced into a loop of a female part of a self-fastening system, it is difficult to remove them by peeling or vertical traction, the loop having the tendency to break as a result of the tractive effect of the very rigid flanges of the mushrooms. For example, in U.S. Pat. No. 6,162,040, the mushrooms obtained have very rigid flanges and the self-fastening systems produced with this type of mushroom have a limited life, the loops breaking easily under the tractive effect of the mushrooms. Also, the shape of the cavities of the moulding roller is complicated, bulb shapes being used there to form bulbs which, after pressure, give thick and rigid flanges. In the case of a four-lobe system, the flange does not project from the rod over the entire periphery thereof, complicated systems with cutting lines of reduced strength being provided between the lobes.

The object of this invention is to obviate the disadvantages of a prior art by proposing a production process whereby a mushroom for a self-fastening system can be obtained simply and with high production rates, which mushroom, when used in co-operation with a self-fastening loop, does not damage the latter when the mushroom is pulled out of the loop.

According to the invention, the method of producing a mushroom part of a self-fastening system comprising mushrooms and loops comprises the following steps:

passing between:

- a moulding roller comprising a network of moulding cavities, the cavities each being of cylindrical shape of constant cross-section, or strictly decreasing from the upper opening to the base of the cavity, particularly a circular, square, triangular, lozenge-shaped, cross-shaped or rectangular section, a stud, particularly cylindrical and particularly of circular, square, triangular, lozenge-shaped, cross-shaped or rectangular section, projecting from the bottom of the cavity, preferably substantially at the centre, the cross-sectional dimension of the stud being less than that of the moulding cavity and
- a compression roller,
- liquid or softened thermoplastic material to fill the moulding cavities and obtain at the outlet a band of thermoplastic material from which start studs having a cavity within then, and
- compressing with heating the upper surface of the stud to produce a mushroom according to the invention.

The invention also relates to a mushroom having a cylindrical rod with a longitudinal axis and a constant cross-section or a cross-section which strictly decreases from the base of the rod to the top, a flange projecting laterally from the rod and extending substantially all around the rod, characterised in that the rod has a constant cross-section or one that decreases strictly from the bottom of the rod to its apex, and there is formed in the rod an auxiliary cavity of which the largest section transversely of the rod axis is of a smaller dimension than that of the cross-section of the rod.

The result is a greater flexibility of the mushroom overall, the rod being less rigid and hence undergoing better deformation, particularly laterally, when pulled with peeling (when the mushrooms are separated from the loops of a self-fastening system), and the flange, being less thick, is more apt to undergo deformation or pivot on vertical pulling of the mushroom to release the loop of a female part, so that the mushroom can more easily leave the loop without breaking it. The result is a self-fastening system which is stronger (the loops have less tendency to tear in use) and of a longer life for the same quality (particularly titre) of the loop threads of the female part. Also, these mushrooms can be manufactured at very low cost.

According to one improvement, the flange has the greatest thickness measured in the direction of the axis of the rod of between 0.02 mm and 0.06 mm.

This results in a particularly flexible mushroom which does not break the loops when withdrawn therefrom to open a self-fastening closure of the mushroom and loop type.

The mushrooms according to the invention thus have a behaviour in traction or peeling as good as the conventional hooks (generally obtained by moulding from complicated drawer moulds or by extrusion), while retaining the advantages of conventional mushrooms, particularly the possibility of simpler production in large quantities and at low cost compared with hooks (which, depending upon their orientation, have one if not two preferential directions).

According to one embodiment which is particularly simple to manufacture, the auxiliary cavity extends over substantially the entire height of the rod, i.e. as far as substantially the base thereof. Particularly, the moulding roller can be produced by laser attack with the interposition of a mask which allows the laser beam to pass only to form the annular section corresponding to the annular wall forming the rod.

According to a preferred embodiment of the invention which in particular allows particularly fast production of the mushrooms, the flange projects from the rod over the entire rod periphery, being symmetrical in revolution.

According to an embodiment which gives a mushroom having an excellent hooking quality, the cross-section of the rod is in the shape of a cross or a clover having three to six leaves or lobes, preferably four lobes, and the auxiliary cavity has an identical shape of smaller size, the cross or clover of the cavity being circumscribed in the cross or clover of the rod section.

According to one advantageous embodiment the cross-section of the rod is square, triangular, rectangular, or lozenge-shaped.

According to a particularly preferred embodiment, the depth in the direction of the rod axis of the auxiliary cavity is between 0.02 mm and 0.5 mm, particularly between 0.02 mm and 0.2 mm and preferably between 0.02 mm and 0.1 mm.

The present invention also relates to a self-fastening system of the mushroom and loop type comprising a mushroom part having mushrooms according to the invention.

The invention also relates to mushroom parts of self-fastening systems of the mushroom and loop type having a base band from which mushrooms according to the invention start.

The invention also relates to a moulding roller for the production of mushrooms for mushroom parts of self-fastening systems of the mushroom and loop type, the moulding roller comprising a network of moulding cavities, the cavity being of cylindrical shape, constant cross-section or a cross-section which decreases strictly from the top opening of the cavity as far as the base thereof, particularly circular, square, triangular, lozenge-shaped, cross-shaped or rectangular, characterised in that a lug, particularly cylindrical and particularly circular, square, triangular, lozenge-shaped, cross-shaped or rectangular, projects from the bottom of the cavity, preferably substantially at the centre, the dimension of the lug in cross-section being less than that of the moulding cavity.

According to one preferred embodiment, the lug has the shape of a cross or clover having 3 to 6 lobes, preferably 4 lobes, and the cavity has an identical shape, the cross or clover of the lug being circumscribed in the clover of the cavity.

Embodiments of mushrooms according to the invention will now be described by way of example together with a method of producing mushrooms according to the invention, with reference to the drawings wherein:

FIG. 1*a* is a section of a first embodiment of a mushroom according to the invention.

FIG. 1*b* is a sectional view of another embodiment of a mushroom according to the invention.

FIG. 2 is a top plan view of the mushroom of FIG. 1*a*.

FIGS. 3*a*, 3*b*, 3*c*, 3*d*, 3*e*, 3*f* and 3*j* are identical views to FIG. 2 showing other embodiments of the present invention.

Figure 1A:
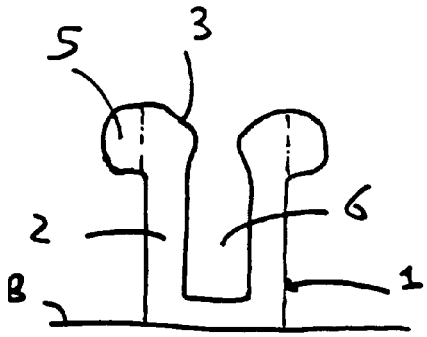

FIG. 1*a* shows a longitudinal section of a mushroom 1 according to the invention. The mushroom 1 is substantially a body of revolution with respect to the longitudinal axis or vertically of the mushroom. The mushroom is formed by a rod 2 extending from the bottom of the mushroom (in this case the mushroom starts from a base strip B) as far as its upper surface 3. The rod 2 is of a cylindrical shape, circular in this case in cross-section.

The cross-section of the rod is constant. According to another possible embodiment, it could be flared, with a cross-section which decreases strictly from the base of the rod towards the apex.

An annular flange 5 projects laterally from the rod 2 all around the top surface 3 of the rod 2.

There is formed in the rod 2 a cavity 6 in the form of a blind hole of cylindrical shape, of circular section, narrowing in the form of a bottleneck in its upper part. The largest cross-section of the blind hole is smaller than the constant cross-section of the rod, the opening 7 of the auxiliary cavity 6 at the upper surface 3 of the rod 2 being strictly circumscribed by the periphery of said upper surface and by the transversal section of the rod (in the case of a constant transversal section) or by the smallest of the transversal section of the rod, ie the transversal section of the rod at the level of the top of the rod (in the case of a decreasing transversal section). In the case in which the cross-section of the rod is not constant but strictly decreasing from the base to the apex, the cross-section of the cavity is still less than that of the rod, irrespective of the height of the rod where it is situated, and particularly at the apex or upper surface of the rod, the cavity does not encroach on the flange and remains strictly circumscribed in cross-section in the transverse (outer) section of the rod.

The depth of the blind hole is, for example, 0.1 mm and is generally between 0.02 mm and 0.5 mm, corresponding to between 10% and 100% of the total height of the rod measured along its longitudinal axis.

Figure 1B:
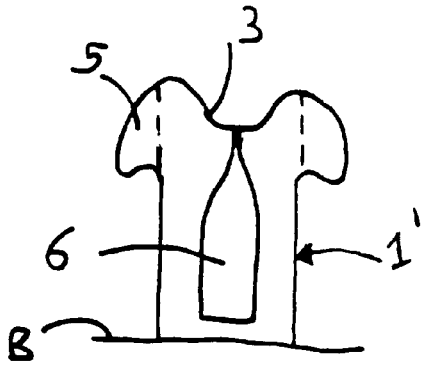
Figure 2:
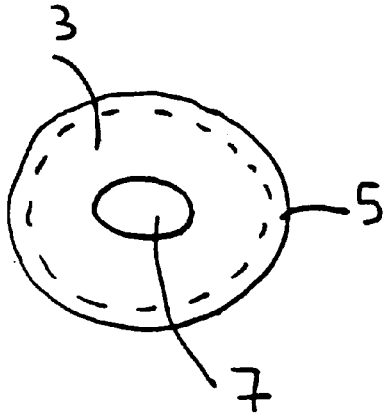
Figure 3A:
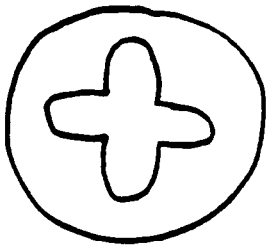
Figure 3B:
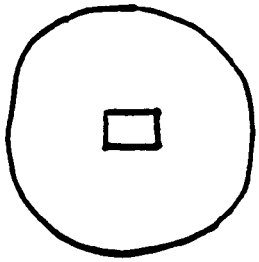
Figure 3C:
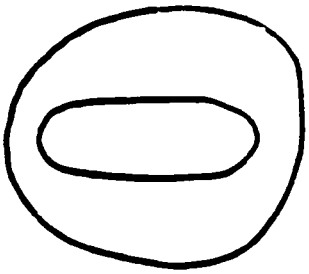
Figure 3D:
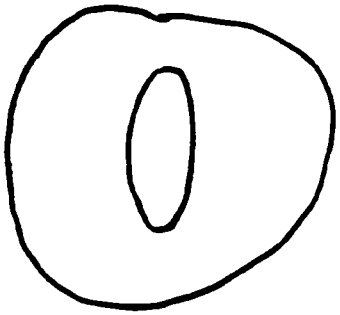
Figure 3E:
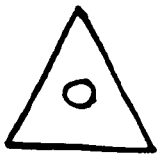
Figure 3F:
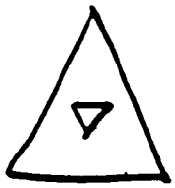
Figure 3J:
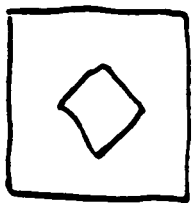

In FIG. 1*b*, the narrowing is such that the cavity 6 is completely enclosed inside the rod 2.

To form these mushrooms 1 (FIG. 1*a*) or 1' (FIG. 1*b*), a liquid or softened film of thermoplastic material, for example polyolefins such as polypropylene or polyethylene, polyester or polyamides, is passed between a compression roller and a moulding roller 20. There is formed in the moulding roller, opening to the outer surface of the roller, a network of moulding cavities 21 each formed by a blind hole of cylindrical shape corresponding to the cylinder of the rod 2, a lug 22 projecting from the bottom of the mould cavity, the shape of the lug 22 corresponding to that of the blind hole 6 formed at the apex of the rod 2.

The moulding cavities are produced particularly by laser attack of the roller material (for example stainless steel or rubber) with the use of one or more masks with patterns corresponding to the cavities. It is also possible to use a controlled laser (for example its focusing lens) so as to create a profile at the bottom of the cavity in the form of a Gaussian curve. In that case, a lug of shallow height is obtained, in the form of a monticule (the shape of the Gaussian curve) at the base of the cavity. In the corresponding mushroom the cavity then has a shallow depth.

At the exit from the moulding roller there is obtained a strip B, from which circular cylindrical rods 2' start, comprising at their apex a hollow 6' of a shape matching that of the lug at the base of the moulding cavity.

By means of a pressure roller with heating thermal compression is then applied to the top part of the intermediate rods 2' in order thus to obtain the final mushrooms 1, the material at the upper part of the rod being deformed radially, laterally outwards, to obtain the flange 5. In some cases, depending on the pressure exerted, the compression will make the upper surface 3 of the rod 2 slightly concave.

The flange 5 will generally have a thickness of between 0.02 mm and 0.2 mm, preferably between 0.02 mm and 0.06 mm, this being weaker and more flexible than in the case of the flanges of current mushrooms.

The term "thickness" of the flange 5 denotes the largest dimension in the direction of the rod height that can be measured in the flange.

The largest width of the rod (its diameter in the case of a constant circular section) may be between 0.2 and 1 mm, particularly 0.3 mm. At the same time, the largest width of the cavity (its diameter in the case of a constant circular section) may be between 25 and 40% of the largest width of the rod, particularly 0.1 mm when the rod has a diameter of 0.3 mm (33%).

The flange generally projects from the rod by a distance which is, for example, constant, of between 0.03 mm and 0.2 mm, preferably between 0.8 mm and 0.1 mm.

FIG. 3 shows other embodiments of a mushroom according to the invention. A number of possibilities of the cross-section of the rod cylinder will be seen, in combination with a number of possibilities of cross-section of the cylinder of the cavity. It is obvious that within the scope of the present invention all possible combinations of each of the cross-sections shown in the drawings for the rod and each of those shown for the auxiliary cavity are possible, for example a lozenge-shaped rod section with a square section of the auxiliary cavity.

Figure 4:
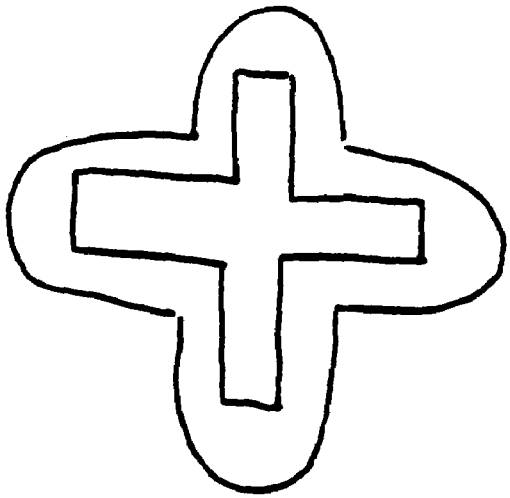
FIG. 4 is an identical view to FIG. 2 of yet another embodiment of the invention.
Figure 5:
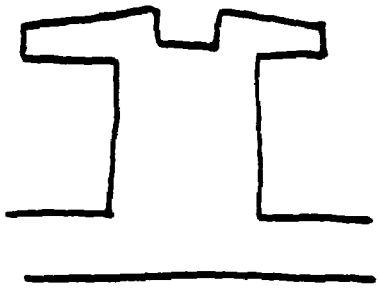
FIG. 5 is an identical view to FIG. 1*a* showing yet another embodiment of the invention.
Figure 6:
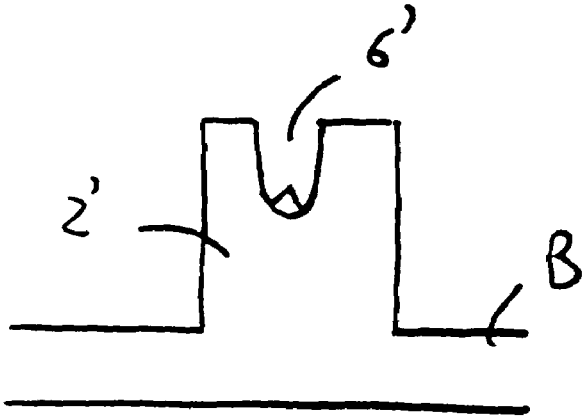
FIG. 6 is a partial section of the intermediate band obtained at the outlet of the moulding roller before thermoforming or thermocompression.
Figure 7:
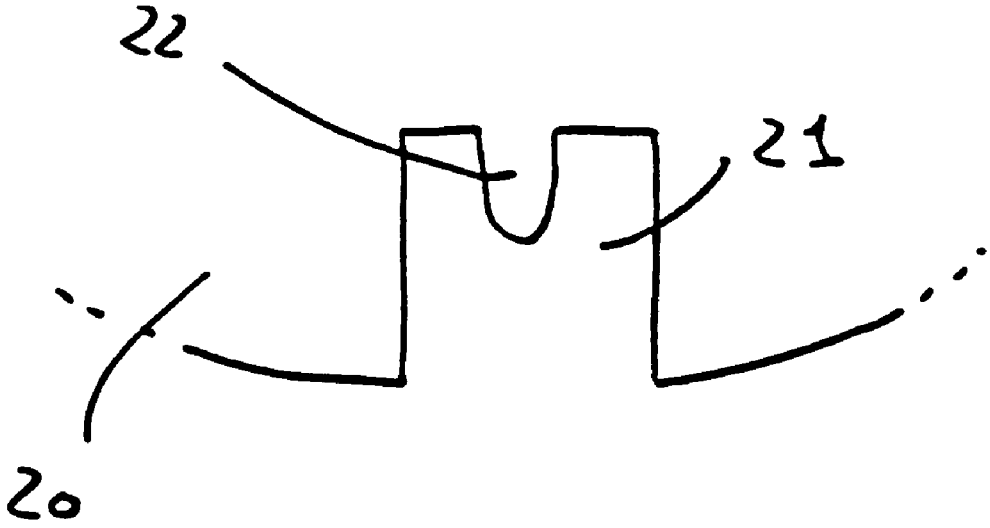
FIG. 7 is a partial view of a moulding roller according to the invention showing a moulding cavity in section for the production of a mushroom according to FIG. 1*a*.

FIG. 4 shows another embodiment of a mushroom according to the invention. The rod of the hook has the shape of a four-lobe clover while the auxiliary cavity has the shape of a four-lobe clover circumscribed in the rod clover. It should be noted that in this embodiment the flange also projects laterally from the rod over the entire periphery of the upper part of the rod. On the other hand, in this embodiment, the extent of the projection varies over the periphery.

It is obvious that it is possible to provide with the four-lobe rod a circular cavity, a square cavity, a lozenge-shaped cavity, an oval cavity, etc., or conversely a rod with a circular section, square section, lozenge-shaped section, oval section, etc, can be combined with a cavity having a four-lobe section.

These various forms make it possible to provide fastening in certain preferred directions and, in particular, longitudinal, lateral or vertical traction or peeling of a self-fastening closure.

The invention claimed is:

1. A male element of mushroom shape for a self fastening closure, comprising a cylindrical rod having a longitudinal axis and a cross section, said cross section being constant or strictly decreasing from the base to the top of the rod, a flange protruding laterally from the rod and defining a mushroom head that extends itself all around said rod, wherein an auxiliary cavity is formed in the rod, the largest cross section of said auxiliary cavity, transversely to said longitudinal axis, being of a smaller dimension than any cross section of said rod; and said cavity is open to the outside on the top of the rod.

2. A male element as defined in claim 1, wherein the flange has a greatest thickness as measured along said longitudinal axis comprised between 0.02 mm and 0.06 mm and said flange protrudes from said rod by a distance comprised between 0.08 mm and 0.1 mm.

3. A male element as defined in claim 1, wherein the auxiliary cavity extends vertically from a bottom, and said bottom is at a level, measured along said longitudinal axis, which is below said flange.

4. A male element according to claim 1, characterized in that the auxiliary cavity extends over substantially the entire height of the rod, i.e. as far as substantially the base thereof.

5. A male element according to claim 1, characterized in that the cross-section of the rod is in the shape of a cross or a clover having three to six leaves or lobes, and the auxiliary cavity has an identical shape of smaller size, the cross or clover of the cavity being circumscribed in the cross or clover of the rod section.

6. A male element according to claim 1, characterized in that the depth, in direction of the rod axis, of the auxiliary cavity is between 0.5 mm and 0.02 mm.

7. A male element according to claim 1, characterized in that the cavity is of constant cross section and has a largest width being between 25 and 40% of the total largest width of the rod.

8. A mushroom part for a self-fastening system comprising a base band from which male elements according to claim 1 start.

9. A male element of mushroom shape for a self fastening closure, comprising a cylindrical rod having a longitudinal axis and a cross section, a flange projecting laterally from the rod and defining a mushroom head that extends itself all around said rod, wherein an auxiliary cavity is formed in the rod, the largest cross section of said auxiliary cavity, transversely to said longitudinal axis, being of a smaller dimension than any cross section of said rod; and said cavity is closed.

10. A male element as defined in claim 9, wherein said cross section is constant or strictly decreasing from the base to the top of the rod.

11. A male element as defined in claim 9, wherein the flange has a greatest thickness as measured along said longitudinal axis comprised between 0.02 mm and 0.06 mm and said flange protrudes from said rod by a distance comprised between 0.08 mm and 0.1 mm.

12. A male element as defined in claim 9, wherein the auxiliary cavity extends vertically from a bottom, and said bottom is at a level, measured along said longitudinal axis, which is below said flange.

13. A male element according to claim 9, characterized in that the auxiliary cavity extends over substantially the entire height of the rod, i.e. as far as substantially the base thereof.

14. A male element according to claim 9, characterized in that the cross-section of the rod is in the shape of a cross or a clover having three to six leaves or lobes, and the auxiliary cavity has an identical shape of smaller size, the cross or clover of the cavity being circumscribed in the cross or clover of the rod section.

15. A male element according to claim 9, characterized in that the depth, in direction of the rod axis, of the auxiliary cavity is between 0.5 mm and 0.02 mm.

16. A male element according to claim 9, characterized in that the cavity is of constant cross section and has a largest width being between 25 and 40% of the total largest width of the rod.

* * * * *